United States Patent [19]

Gaquére

[11] Patent Number: 4,526,067

[45] Date of Patent: Jul. 2, 1985

[54] AUTOMATIC MOUNTING APPLIANCE FOR ASSEMBLING MEANS

[75] Inventor: Jean-Pierre Gaquére, Somme, France

[73] Assignee: Societe Nationale Industrielle et Aerospatiale, Paris, France

[21] Appl. No.: 466,387

[22] Filed: Feb. 14, 1983

[30] Foreign Application Priority Data

Feb. 17, 1982 [FR] France ..... 82 02597

[51] Int. Cl.[3] ..... B25B 17/00

[52] U.S. Cl. ..... 81/55; 81/56; 81/456; 81/477; 81/58.3

[58] Field of Search ..... 81/55, 56, 125, 13, 81/456, 477, 58.3

[56] References Cited

U.S. PATENT DOCUMENTS

| | | | |
|---|---|---|---|
| 3,156,141 | 11/1964 | Plantz | 81/13 |
| 3,162,072 | 12/1964 | Stewart | 81/55 |
| 3,263,320 | 8/1966 | Jones | 81/55 |
| 3,314,316 | 4/1967 | Finkle | 81/55 |
| 3,331,268 | 7/1967 | Jones et al. | 81/55 |
| 4,286,482 | 9/1981 | Marsch et al. | 81/55 |

FOREIGN PATENT DOCUMENTS 1491450 6/1966 France .

*Primary Examiner*—James L. Jones, Jr.

*Attorney, Agent, or Firm*—Karl W. Flocks; Sheridan Neimark; A. Fred Starobin

[57] ABSTRACT

An automatic mounting appliance for assembling clamp pins, screws, nuts and the like is adapted to be installed on a machine driven into rotation by a motor. The appliance comprises coaxial elements i.e. a holding member for receiving a portion of the pins, screws, or nuts terminated at one end by a socket, a gripping member having angular shift with respect to the holding member and terminated at one end by a socket axially adjacent to the first mentioned socket, both sockets being in coincidence only in one of two end positions, a rotary member driven by the motor, a stationary member, and a driving member radially interposed between the rotary and gripping members to frictionally drive the gripping member from the rotary member, whereby the angular shift permits locking or unlocking of the pins, screws, or nuts depending on the direction of rotation.

10 Claims, 6 Drawing Figures

AUTOMATIC MOUNTING APPLIANCE FOR ASSEMBLING MEANS

This invention relates to automatic mounting appliances or devices for assembling means such as screws, nuts, bolts, clamping pins and the like, and more particularly to implementation thereof on corresponding driving machines, whether the latter be manual of the screwing/unscrewing type, or automatized or robotized machines to permit the locking or unlocking of the assembling systems in said mounting appliances.

Such automatic mounting devices must meet a first requirement consisting of ensuring safe and accurate positioning of the assembling means at its location, which is represented by the hole(s) in which it is to be fitted.

The machines provided with devices of this type, known at present by the Applicant, are not entirely satisfactory because the maintaining of the assembling means, which in most cases is provided by adhesion means, is not as safe as a mechanical locking method for providing a positive maintaining thereof.

Certain solutions in this direction have already been proposed for serving the intended purpose:

Thus, the U.S. Pat. No. 3,331,268 discloses a screwing/unscrewing nose for clamping pins comprising a positive locking means but the utilization of the latter is not automatic.

The non-automatic screwing/unscrewing nose considered therein substantially comprises two coaxial members, one of which being internal provides for the rotational motion associated with the screwing/unscrewing operation and the other being external and connected to a stationary member provides for the proper positive locking of a clamping pin within the nose.

Such locking which is realized manually according to said U.S. patent results from a limited rotary motion of the outer member relative to the stationary member (30° in the case considered where the socket configurations are hexagonal), said outer member housing its socket through the outer surface of the assembling system, gripping engagement of the latter being effected by putting out of coincidence the angles of the six sided element of the outer member of said nose.

It results from the foregoing that such operation is not totally automatic since it is necessary for the operator to exert the rotational motion causing the assembling system to be locked or unlocked on its mounting device.

The object of this invention is to solve this problem by making such an operation entirely automatic and to this end, proposes an automatic mounting appliance for assembling means: such as clamping pins, screws, nuts, to be mounted on a machine comprising a rotational driving motor disposed in a housing, said automatic mounting appliance being characterized in that it comprises the following coaxially disposed elements:

- a holding member to receive a portion of the assembling means,
  terminated at one end by a socket with a non circular cross-section complementary to the portion of the assembling means which is to be maintained;
- a gripping member capable of a predetermined angular shift relative to the holding member between two end positions, terminated at one end by a socket axially adjacent to the socket of the holding member, and having the same cross-section as the latter, both sockets being in coincidence only in one of the end positions;
- a rotary member joined to the motor;
- a stationary member connected to the housing to which the holding member is attached at least frictionally; and
- a driving member interposed in the radial direction between the rotary and gripping members and adapted to frictionally drive the gripping member from the rotary member, whereby, depending on the direction of rotation of the rotary member, the gripping member is shifted angularly relatively to the holding member between its end positions either in the direction of the locking mode or in the direction of the unlocking mode of the assembling means in the mounting appliance.

Due to a driving member according to the invention, the limited rotation between holding and gripping members to permit the desired locking and/or unlocking thereof is produced automatically during the screwing or unscrewing modes.

This invention will be better understood in the following description of exemplifying not limitative forms of embodiment adapted for various types of assembly, which is made with reference to the attached drawings on which:

Figure 1:
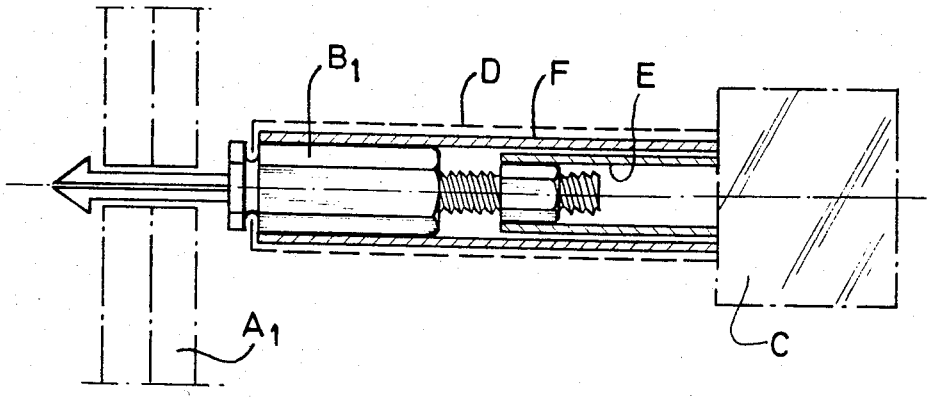
FIG. 1 is a schematic axial view of a clamping pin mounting and locking device according to the prior art.

The prior art shown in FIG. 1 relates to a screwing and unscrewing nose for clamp pins of an assembly A1. The clamp pin proper B1 comprises a hexagonal body axially traversed by a screw pin clamp mechanism actuated by the tightening force of a nut. The assembly is driven by a generally pneumatic machine C. The intended purpose is first to cause the clamp pin B1 to be locked through an outer gripping member D coaxial of a rotary member E driven by the motor of the machine and connected to a member F stationary relative to the machine housing; said locking is realized through rotation by 30° of member D relative to member F which holds the clamp pin body. A reversed 30° rotational motion causes the clamp pin to be unlocked.

Figure 2:
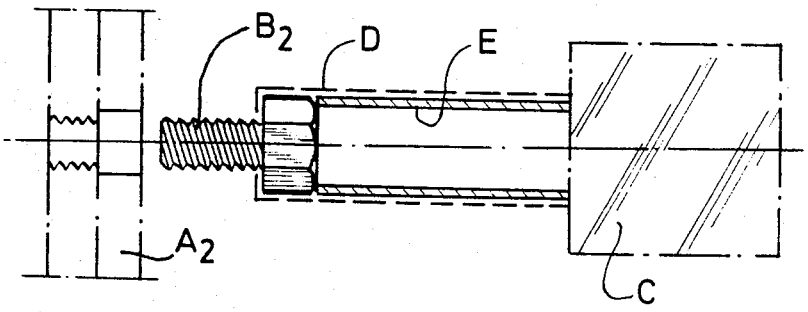
FIG. 2 is a schematic axial view showing the structural configuration of a screw driving device obtained by extrapolation from the schematic device of FIG. 1.
Figure 3:
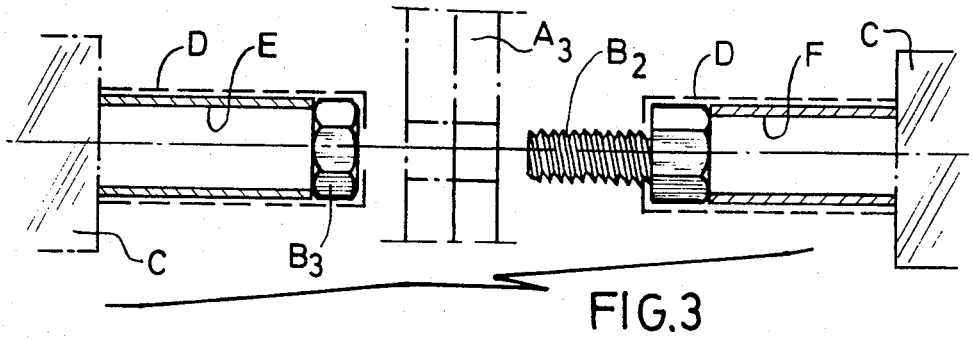
FIG. 3 is a schematic axial view showing the structural configuration of a screw and nut driving device obtained by extrapolation from the device of FIG. 1.

The prior art shown in FIG. 1 can be modified by extrapolation to come to the case of a screw assembly A2 according to FIG. 2 or to that of a bolted assembly A3 according to FIG. 3.

In the first case, the combinations of the elements to be actuated in the mounting device is then D-E for screw B2 which is to be driven into rotation, whereas in the next case, it is D-F for screw B2 and D-E for nut B3, which is to be driven into rotation relative to screw B2.

In any case, the machine C is adapted to provide the rotational and axial motion sequences as required for mounting the assembling systems, said sequences however not being covered by the invention.

According to the prior art shown hereinabove, it can be readily seen that the limited rotation of the outer member D relative to either the stationary member F or the rotary member E was always effected manually, since no automatic mode was taught by such prior art.

Therefore, according to this invention, there is proposed hereinafter in the continued description an automatic mounting and locking-unlocking mode, which can be applied in the three assembling cases mentioned above, with various machines such as for example those held manually or else, machines of the automatized or robotized types.

This automatic mode is realized by a fourth drive member rotationally related to the gripping member and which cooperates with the rotary member to enable rotation of said gripping member thereby ensuring said locking mode.

Figure 4:
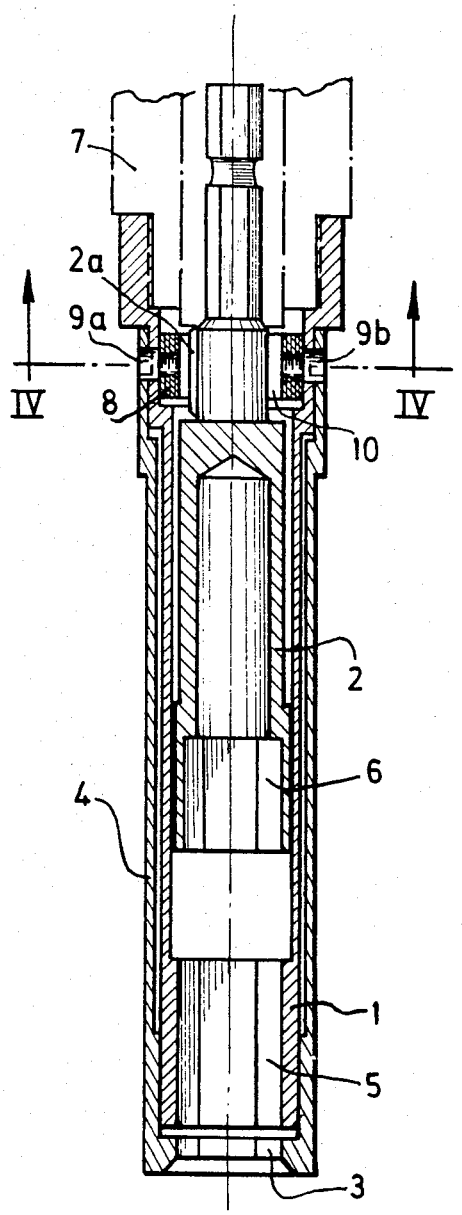
FIG. 4 is an axial sectional view of a screwing and unscrewing nose according to the invention adapted for automatic driving in of clamp pins.

According to FIG. 4, relating to a driving device for a clamp pin not shown, of known type, the stationary member 1 adapted for receiving the clamp pin body in a hexagonal socket 5 is connected to the housing of a driving machine 7, and the rotary member 2 adapted to receive the nut of said clamp pin through a hexagonal socket 6, and to be driven into rotation by the machine motor (not shown), carries a radial boss 2*a* which is one of the constitutive elements of the driving member generally designated by numeral 10.

The gripping member 4 external of members 1 and 2 carries at one end a hexagonal socket 3 identical to socket 5 and axially adjacent thereto.

Said members 1, 2 and 3 are generally of known type and since they do not constitute the essential of the invention they will not be described herein in detail.

Figure 5:
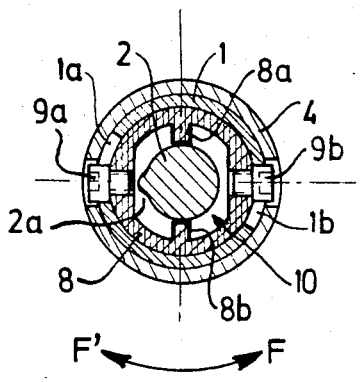
FIG. 5 is a radial cross-sectional view along line IV—IV of FIG. 4.

The driving member 10 the characteristics of which are best seen in FIG. 5 is completed by a flexible annular part 8 made e.g. of neoprene, and carrying radial and axial tongues 8*a*, 8*b* which are two in number in the example shown, on the one hand, and on the other hand, inwardly threaded bulges adapted to receive projection screws 9*a*, 9*b* the head of which are housed in cylindric radial lodgings in member 4, on the one hand, and on the other hand, in circumferential radial slots 1*a*, 1*b* of a preferred angular width of 30° formed in the stationary member 1. It can be readily noted that upon an initial screwing action (according to arrow F) exerted by the motor upon the rotary member 2, the boss 2*a* will act upon the tongues 8*a*, 8*b* so as to drive them and through screws 9*a* and 9*b* rotationally securing members 8 and 4, to put member 4 into that relative position with respect to member 1 which is shown in FIG. 5. The elasticity of tongues 8*a*, 8*b* is such that they can be driven by the boss 2*a* possibly through several turns, up to abutment of screws 9 against the edges of slots 1*a*, 1*b*, then through deformation and/or backward movement they can be passed by said boss in any direction.

In this way, the clamp pin can be fitted in, since the six sides of sockets 5 and 3 are aligned (or in coincidence) with one another.

A reversed unscrewing motion (according to arrow F′ in FIG. 5) will drive the tongues 8*a* and 8*b* which then drive into rotation, through screws 9*a* and 9*b*, the member 4 relative to the stationary member 1 thereby locking the clamp pin, since the socket 3 then rotates by 30° relative to member 5, hence putting the sides thereof out of coincidence (opposition of the hexagonal shapes).

Said 30° amplitude which is preferred in the case of hexagonal sockets corresponds to half the value of the angles between the faces of said sockets. More generally, the preferred rotational angle is the angle permitting the form of the head to be brought into opposition relative to itself.

The locked clamp pin can then be fitted through the hole in the assembly to be made, then fitted therein by screwing the nut, driven into rotation although it is held axially stationary through member 2, relative to the clamp pin mechanism which thus slides in the clamp pin body maintained by the stationary member 1. The clamp pin then becomes unlocked.

Upon completion of the screwing of the clamp pin, as the nose is no longer locked to the clamp pin, it can be easily removed therefrom and introduced onto the next one, and so on.

It is noted that the operation follows from the screwing or unscrewing actions which correlatively cause the clamp pin to be unlocked or locked, which is the specific object of this invention.

Figure 6:
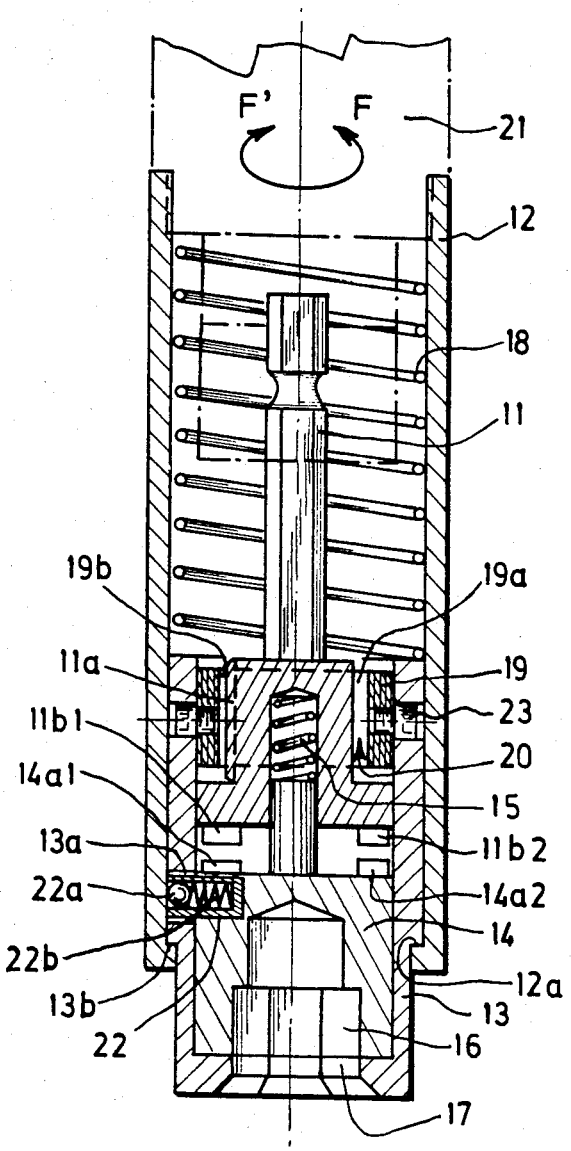
FIG. 6 is an axial cross-sectional view of a screwing and unscrewing nose according to the invention adapted for automatic driving of screws and nuts.

According to FIG. 6, which applies to standard bolting (six sided elements) but may also be adapted to any other bolting heads, particularly, polygonal ones, that may be put into opposition with respect to sockets of the same form through rotation by a determined angle, the process must be modified and adapted thereto, since the screw and/or nut only engages two elements, and moreover, in certain cases, the rotational action upon the screw (or the nut) is suppressed while the locking action is always required.

In the same way as in the foregoing description, the stationary member 12 is connected to the housing of the machine 21 (in a known manner) and the rotary member 11 driven by a motor, not shown, provided in the machine carries a radial boss 11*a* which is one of the constitutive elements of the driving member denoted as a whole by numeral 20.

In the exemplifying form of embodiment shown, the gripping member 13 carries at one end a hexagonal socket 17 identical to socket holding 16 of a member 14 for maintaining the screw (or the nut).

Holding member 14 is formed with axial clutch teeth 14*a*1 and 14*a*2 on the one hand, and on the other hand, with at least one screw 22 with a ball 22*a* and a spring 22*b*, the external part of which is housed within a circumferential radial slot 13*a* preferably extending over 30°, formed in member 13.

These clutch teeth are disposed so as to face other axial teeth 11*b*1, 11*b*2, joined to the rotary member 11.

A first spring 15 disposed axially in an axial recess in member 11 against a complementary protuberance connected to member 14, aims to maintain teeths 14*a* and 11*b* axially separated, and a second spring 18 having a stiffness lower than that of spring 15 urges part 13 (containing part 14) provided with a shoulder 13*b* to abut against a transverse shoulder 12*a* of the stationary member 12.

Finally, the driving member 20 is completed by an elastic part 19 similar to part 8, carrying radial and axial tongues 19*a*, 19*b*, and securement thereof to member 13 is provided by screws 23 of any known type which are not described here in detail.

Analogous to the preceding example, an unscrewing action exerted by the motor according to direction F (which may be a short action) is such as to drive the rotary member 11 which in its turn drives member 13 by means of screws 23. The latter then rotates by 30° relative to member 14 which is braked due to the occurrence of frictions resulting from application of the ball 22*a* upon the stationary member 12. The same comments as above on the selected amplitude of 30° also apply.

The six sides of members 13 and 14 being in coincidence, a screw (or a nut) head not shown can be introduced into sockets 17 and 16.

The screwing action (according to arrow F') produces the locking due to the member 11 driving member 13 which rotates by 30° relative to member 14 still braked by frictions resulting from pressure of ball 22*a* upon member 12. Once the 30° shift is obtained member 14 can if the case arises be driven into rotation in its turn.

The elasticity of tongues 19*a* and 19*b* is such as to permit them to be driven by boss 11*a* possibly in several turns up to circumferential abutment of screw 22 against one edge of slot 13*a* without however being able to transmit member 13 the whole of the driving torque of member 11. Member 13 rotates less quickly than the latter.

The screwing action through member 13 is continued until the clutch teeth, due to the device being pushed in the direction of the assembly to be made, have been brought into the configuration of rotational driving.

The clutch action resulting from the simultaneous axial backward movement of members 14 and 13 in the stationary member 12 is accompanied by the unlocking due to the fact that the direct positive driving of member 14 by member 11 overcomes the frictional driving of member 13 resulting from the action from boss 11*a* upon tongues 19*a* and 19*b*. Then, member 13 moves back by 30° relative to member 14.

In other words, the angular motion producing the unlocking effect occurs when the clutch means are operative although the machine always remains in the screwing position. Thus, the unscrewing effect is obtained either through unscrewing, or screwing and clutching.

The axial release after stopping, during the screwing, therefore permits removal of the mounting nose in the unlocked position, thereby allowing insertion of a new screw or nut and then, proceeding through a new mounting cycle.

It will be understood that when the screw must remain stationary, only locking or unlocking pulses are necessary. The system described with reference to FIG. 4 where the stationary member 1 would have a single-handed socket 5 would produce the expected results, as the rotation of the rotary member 2 has no longer the object of carrying out the locking and unlocking operations. Obviously, it is possible to simultaneously drive into rotation the screw and the nut but contrariwise.

Furthermore, the illustrated devices are adapted for a six-sided configuration, but any other configuration (not circular: square, triangle, oval, and so on) capable of being brought into opposition with itself through rotation of a determined angle would also be appropriate.

Finally, the frictional driving systems transmitting torque through the rotary member to the gripping member, which have been described as being formed of a flexible part with tongues could be designed entirely differently, in the same manner as the ball and spring frictional system between the stationary member and the holding member might be different in as far as the obtained results mentioned above should be the same. Furthermore, the bosses could be provided in any number.

It is to be noted that spring 18 which is used only as a holding means may if desired be dispensed with.

It will be understood that this invention was only described and represented by way of an exemplifying preferential mode of embodiment and that technical equivalent parts can be substituted for its constitutive elements without however departing from its scope as defined in the appended claims.

I claim:

1. A mounting device for assembling hardware of type including clamp pins, screws, nuts, and the like installed connected to a rotational driving motor disposed in a housing wherein the mounting device comprises a rotary member connected to the motor, a first socket mounted coaxially to said rotary member with a non-circular cross-section at one end complementary to a portion of the hardware to be assembled to receive the hardware to be assembled, a gripping means mounted coaxially to said first socket and angularly shiftably in relation to said first socket and having at one end a second socket having the same cross-section as said first socket with said first and second sockets mounted axially aligned with each other, as said first socket, a stationary member joined to the housing with said first socket connected to said stationary member, flexible driving means radially interposed between said rotary member and said gripping means to engagingly drive said gripping means from said rotary member, means to angularly shift said gripping means relative to said first socket into a position with said first socket in non-coincidence with said second socket to lock the hardware in the mounting device when said rotary member rotates in one direction and to angularly shift said gripping means relative to said first socket into a position with said first socket in coincidence with said second socket to unlock the hardware from the mounting device when said rotary member rotates in an opposite direction.

2. A device according to claim 1, wherein said first and second sockets have a polygonal shape.

3. A device according to claim 2, wherein said first and second sockets are hexagonal and the relative angular shifting between said gripping means and said first socket is 30°.

4. A device according to claim 1, wherein said driving means includes a radial boss connected to said rotary member, a flexible member connected to said gripping means having flexible tongues extending therefrom positioned for rotational cooperation with said boss.

5. A device according to claim 4, wherein said first socket is integral with said stationary member, and screws passing through said stationary member by means of circumferential slots in said stationary member connect said flexible member to said gripping means.

6. A device according to claim 1, wherein said angularly shifting means includes a radially projecting means to provide limited relative angular shift between said first socket and said gripping means, which is connected to one of them and penetrates a circumferential slot formed in the other.

7. A device according to claim 1, the hardware being clamping pins having a body and a mechanism slidable through the body by screwing and unscrewing a nut on the mechanism wherein said first socket is connected to said stationary member, and said rotary member includes a socket for receiving the nut.

8. A device according to claim 1, the hardware being screws and nuts wherein complementary axial clutch means are mounted on each said first socket and said rotary member, radial friction means is mounted on said first socket to pass through said gripping means to maintain frictional contact with said stationary member, means positioned to act on said rotary member and said first socket to allow an axial shift of said first socket and said rotary member relative to each other between a separation configuration in which they are maintained elastically, and an approaching configuration in which said clutch means cooperate with each other,

*said gripping means varying its rotational position* relative to said first socket upon maintenance of the direction of rotation of said rotary member.

9. A device according to claim 8, wherein said radial friction means includes a ball screw disposed in said first socket having a ball and a spring positioned to urge said ball towards said stationary member.

10. A device according to claim 1, the hardware being a nut wherein said first socket and said stationary member are connected to one another.

* * * * *